United States Patent [19]

Lenz et al.

[11] 3,935,811

[45] Feb. 3, 1976

[54] BOLSTER TABLE DEVICE FOR PUNCH PRESS

[75] Inventors: John O. Lenz, Coon Rapids; Ingo E. Wolfe, Minneapolis, both of Minn.

[73] Assignee: Kurt Manufacturing Company, Inc., Minneapolis, Minn.

[22] Filed: Sept. 16, 1974

[21] Appl. No.: 506,412

[52] U.S. Cl. ..... 100/53; 72/448; 83/266; 83/563; 100/DIG. 18; 100/229 R; 214/1 F

[51] Int. Cl.[2] ..... B30B 15/06; B30B 15/30

[58] Field of Search ..... 72/419, 448; 83/266, 563; 214/1 F; 100/DIG. 18, 229 R, 221, 224, 215, 53; 425/455

[56] References Cited

UNITED STATES PATENTS

| | | | |
|---|---|---|---|
| 2,534,780 | 12/1950 | Lovenheim et al. | 83/266 X |
| 2,910,727 | 11/1959 | Salbeck et al. | 425/455 X |
| 2,988,234 | 6/1961 | Barothy et al. | 100/229 R |
| 3,230,869 | 1/1966 | Wilkins | 100/229 R |
| 3,427,855 | 2/1969 | Michelson | 72/448 |
| 3,446,106 | 5/1969 | Ferris et al. | 83/563 X |
| 3,818,748 | 6/1974 | Smit | 72/448 |

*Primary Examiner*—Billy J. Wilhite

*Attorney, Agent, or Firm*—Williamson, Bains & Moore

[57] ABSTRACT

A bolster table device for a punch press includes a reciprocable table positioned upon a support plate and movable along guideways. The support plate and table have inclined confronting planar surfaces which engage each other when the table is in a retracted position whereby the entire impact load exerted by the punch press is transferred to the support plate. The inclined confronting planar surfaces of the table and support plate are spaced from each other when the table is shifted towards and away from the retracted position. The bolster table is reciprocated by a closed hydraulic system which is operated by a driven cam device.

10 Claims, 4 Drawing Figures

BOLSTER TABLE DEVICE FOR PUNCH PRESS

SUMMARY OF THE INVENTION

This invention relates to a bolster table device for a punch press apparatus.

Reciprocating bolster table devices for punch presses have been developed over the past few years in order to minimize the danger to punch press operators. However, many of these prior art reciprocating bolster table devices are inefficiently constructed and are often subject to jamming.

It is an object of this invention to provide a novel reciprocating bolster table device which utilizes a closed fluid pressure system for reciprocating the bolster table through a cycle between extended outer and retracted inner positions, the fluid pressure system being operated by a driven cam device. The driven cam device is arranged and constructed to permit maximum acceleration of the bolster table during the major portion of its cyclic travel, but efficiently decelerating the table during terminal portions of the operating cycle. By utilizing a cam operated closed fluid pressure system to reciprocate the bolster table, the system has inherent resiliency which precludes jamming of the table and thereby permits the bolster table to reciprocate through a complete cycle even though its travel may be obstructed by a workpiece.

The cam operated fluid pressure system is also readily adaptable to permit the bolster table device to be preset to a comfortable operating speed for the punch press operator.

Another object of this invention is to provide a novel punch press reciprocating bolster table in which the reciprocating table and underlying support plate have confronting, inclined, planar surfaces that engage each other only when the table is in an inner retracted position. The table is supported by guideways during its movement to and from the retracted position so that there is little friction load exerted by the table during its reciprocating movement. The support plate that solidly supports the table in the retracted position receives the impact load of the punch press during the working cycle of the latter. The guideways for the reciprocating table are therefore protected against impact loads exerted by the punch press, even though the guideways support the table during most of its travel.

These and other objects and advantages of this invention will more fully appear from the following description made in connection with the accompanying drawings wherein like reference characters refer to the same or similar parts throughout the several views.

FIGURES OF THE DRAWINGS

DESCRIPTION OF THE PREFERRED EMBODIMENTS OF THE INVENTION

Figures 1, 2, 3, 4:
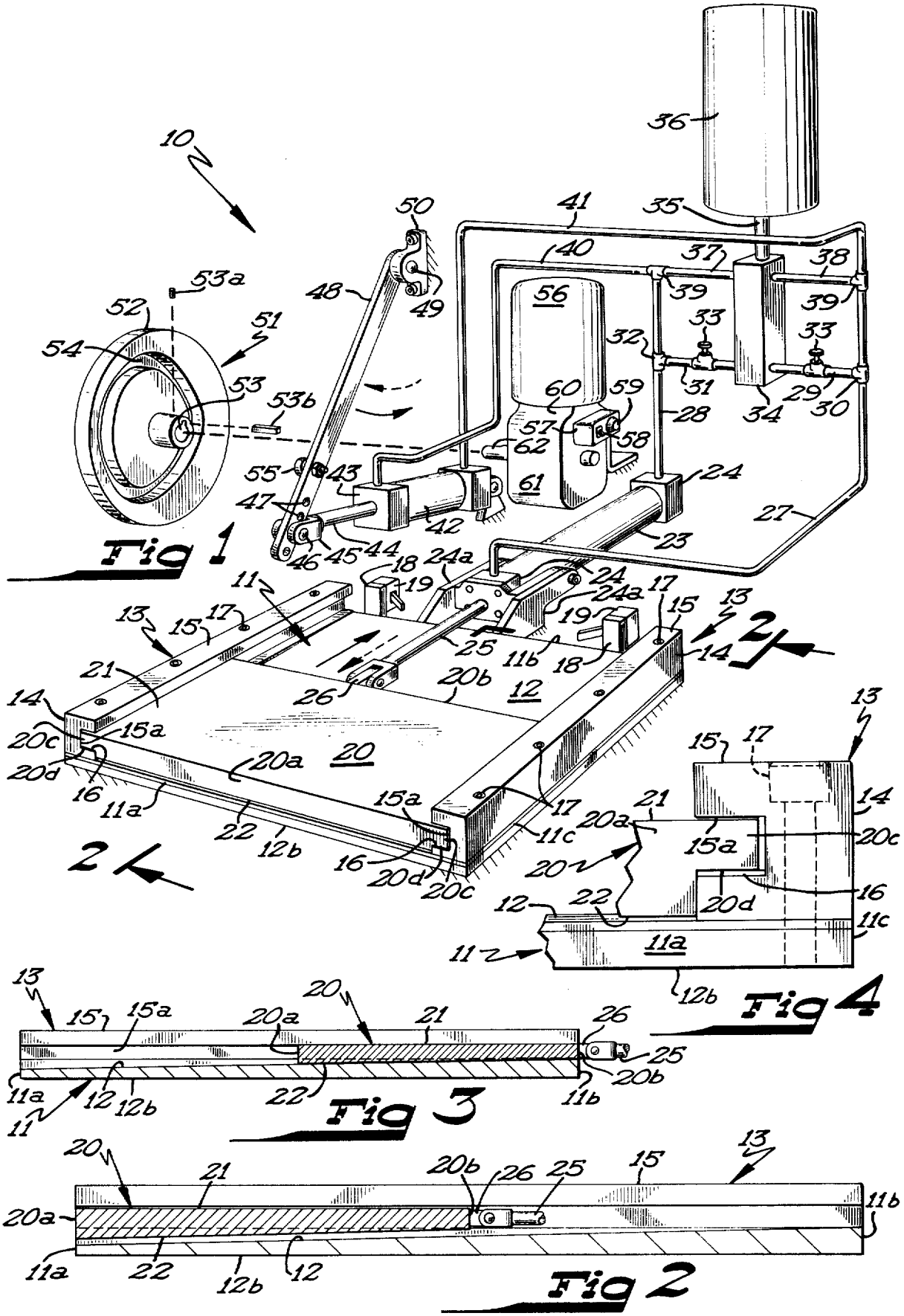
FIG. 1 is a diagrammatic perspective view of the novel table device.
FIG. 2 is a cross-sectional view of the table device taken approximately along line 2—2 of FIG. 1 and looking in the direction of the arrows.
FIG. 3 is a view similar to FIG. 2, but illustrating the bolster table in an outer extended position.
FIG. 4 is a fragmentary elevational view of the table and support plate.

Referring now to the drawings, and more specifically to FIG. 1, it will be seen that one embodiment of my novel bolster table device, designated generally by the reference numeral 10, is there shown. The bolster device 10 includes a generally rectangular shaped support plate 11, having an outer edge 11*a* and an inner edge 11*b*, and substantially parallel side edges 11*c*. The support plate 11 has a planar inclined upper surface 12 which is inclined downwardly and outwardly, as best seen in FIGS. 2 and 3, and has a substantially flat lower surface 12*b*.

A pair of similar elongate guide channels 13 are secured to the support plate 11 adjacent the side edges 11*c* thereof. The guide channels 13 each include a web 14 having upper and lower flanges 15 projecting therefrom. The upper surface of the lower flange 15 for each guide channel defines a guideway 15*a* which may be provided with a shim surface 16 to accurately form the guideway. Bolts 17 secure the guide channels 13 to the support plate 11. A pair of laterally spaced apart, similar, generally rectangular shaped stop blocks 18 are rigidly secured to the inner edge 11*b* of the support plate 11 by suitable bolts or the like. Each stop block 18 has a limit switch 19 mounted on the outer or front surface thereof as best seen in FIG. 1.

A generally rectangular shaped reciprocating table 20 is positioned above the support plate 11 and has an inner edge 20*a*, and outer edge 20*b* and reduced side edge portions 20*c* which are disposed in the guide channels 13. The lower surface 20*d* of the reduced side edge portions 20*c* engage the guideways 15*a* of the guide channels during movement of the reciprocating table 20. The reciprocating table 20 has a substantially flat upper surface 21 which is substantially parallel to the lower surface 20*d* of the reduced side edge portions 20*c* and is substantially parallel to the guideways 15. However, the bolster table 20 has a planar inclined lower surface 22 which is inclined downwardly and outwardly and defines a complimentary matching confronting surface with respect to the upper inclined surface of the support plate 11.

The table 20 is reciprocated through an operating cycle between the outer extended position, as illustrated in FIG. 3, to an inner retracted position, as shown in FIG. 2, and is returned to its outer retracted position. In this respect, the table 20 is adapted to support a workpiece jig which contains the workpiece to be engaged by a punch press. When the table is in the inner retracted position, the punch press will be vertically shifted downwardly from a retracted position and will engage the workpiece in performing a shaping, cutting or smearing function and will then be returned to the upper retracted position. When the table is shifted to the outer extended position, the punch press operator removes the formed workpiece and replaces it with a workpiece for the next cycle. It is pointed out that the bolster table device is intended for use with any conventional punch press, it being acknowledged that such punch presses are well known in the art.

It will be seen that when the table 20 is in the retracted inner position, the lower surface of the table engages and rests solidly against the upper surface of the support plate 11. Therefore, when the punch press moves downwardly to engage the work piece supported on the table, the impact force of the press will be transmitted directly to the support plate. However, as soon as the table is moved from the fully retracted inner position, these confronting inclined surfaces on the table and upper plate will be spaced from each other and the table will be supported entirely by the guideways 15*a*. This reduces the friction load and very little effort is needed to shift the table through a complete cycle. It will therefore be seen that during a complete cycle, the table is supported by the guideways during a major portion of its travel.

Means are provided for reciprocating the table 20 through its cycle of operation and this means actually comprises a closed circuit hydraulic system, including hydraulic slave cylinder 23. The hydraulic slave cylinder 23 is provided with front and rear cylinder blocks 24 which may be mounted on any suitable structure closely adjacent the support plate and associated table 20. The hydraulic slave cylinder is provided with a piston to which is attached a piston rod 25, the latter being secured to an attachment block 26, secured to the inner edge 20*a* of the table 20. It will be seen that when the piston rod is extended, the table 20 will be shifted in an outward direction and when it is retracted, the table will also be retracted to the inner retracted position as best seen in FIG. 2.

One end of an elongate conduit 27 is connected to the front hydraulic cylinder block 24 and one end of a second conduit 28 is connected in communicating relation with the rear block 24. The other end of the conduit 27 is connected to a branch conduit 29 by means of a T-fitting 30, while the conduit 28 is connected to a branch line 31 by means of a T-fitting 32. The branch conduits 29 and 31 each have a valve 33 disposed in flow controlling relation therewith, and each branch conduit is connected in communicating relation with a manifold 34. The manifold 34 is connected by a conduit or pipe 35 to a reservoir 36 which is adapted to contain a predetermined amount of hydraulic fluid. The hydraulic fluid will flow by gravity downwardly through the pipe 36 into the manifold 34. The T-fitting 32 is connected to a branch conduit 37 by means of a fitting 39 while the fitting 30 is connected to a branch conduit 38 by a second fitting 39. It will be noted that the branch conduits 37 and 38 are connected in communicating relation with the manifold 34. It will also be noted that the branch conduit 37 is connected to one end of a conduit 40 and that branch conduit 38 is connected in communicating relation with one end of a conduit 41.

The closed circuit hydraulic system also includes a master cylinder 42 provided with front and rear cylinder blocks 43 and having a piston movable therein. It will be noted that the conduit 40 is connected to the front cylinder block 43 while the conduit 41 is connected to the rear cylinder block.

The piston for the master cylinder 42 is connected to a piston rod 44 which is provided with spaced apart ears 45 at its outermost ends. A pivot pin 46 is disposed in one of a plurality of openings 47 located in the lower end portion of an elongate operating lever 48. The upper end of the operating lever 48 is pivotally connected by a pivot 49 to a bearing block 50 which may be rigidly mounted on a suitable support frame for the bolster table device. It will be seen that when the operating lever 48 is pivoted about its pivotal axis, the piston rod 44 will be extended and retracted with respect to the master cylinder 42. Extension and retraction of the piston rod operates the slave cylinder 23 which in turn reciprocates the table 20.

Means are provided for operating the closed hydraulic system and this means includes a cam mechanism 51 including a generally circular flat cam plate 52 having a central opening 53 therein. The cam plate is provided with a continuous cam groove 54 in one surface thereof. The continuous cam groove 54 accommodates a cam follower or roller 55 therein which is revolvably mounted on the operating lever 48 intermediate the ends thereof.

Means are provided for rotating the cam plate 42 and this means includes an electric motor 56 having a speed control device 57 connected thereto in controlling relation therewith. The speed control device 57 is provided with a conventional on-off switch 58 and is also provided with a speed control knob 59. The speed control knob 59 may be rotated to vary the speed of the electric motor 56. The electric motor 56 is connected to a speed reducer mechanism 60 which is drivingly connected to a conventional hydraulic rotary pump 61. The cam plate 52 is fixedly mounted on the output shaft 62 of the rotary hydraulic pump 61, and it will be seen that when the electric motor 56 is energized, the cam plate 52 will be rotated.

During operation of the apparatus, the electric motor will be energized by the on-off switch 58 and the speed control knob will be adjusted to a predetermined desired speed. The output shaft 62 of the rotary hydraulic pump 61 will be revolved thereby driving the cam plate 52. The cam follower 55 will be moved relative to the cam groove 54 in the cam plate which will swing the operating lever in a fore and aft direction. As the operating lever is pivoted in a fore and aft direction, the piston rod 44 will be alternately extended and retracted with respect to the master cylinder 42. Since the present system is the closed circuit hydraulic system, retraction of the piston rod 44 will cause extension of the piston rod 25 of the slave cylinder 23. Conversely, extension of the piston rod 44 will cause retraction of the piston rod 25. Thus it will be seen that the table 20 will be continuously shifted through its operating cycle.

Although not shown in the drawing, the bolster table device will be used with a punch press apparatus of the type which is provided with a pair of operating handles which must be simultaneously shifted in order for the press to be operated through its operating cycle. It is also pointed out that the normally open limit switches 19 are interconnected to the punch press operating circuitry and must therefore be depressed and closed by the table 20 when the latter is in the fully retracted position in order to permit the punch press to shift through its operating cycle. Therefore, in the event that a workpiece inadvertently falls from the table and obstructs movement of the table 20 during its movement to the fully retracted position, the limit switches 19 will not be closed. The punch press will therefore be unable to operate through its working cycle but the table 20 will continue through its return travel to complete its cycle. With this arrangement, there is no danger of the bolster table device becoming jammed by a misplaced workpiece.

The capacility of the table 20 to move through a complete cycle even though it is obstructed against movement through a fully retracted position, is attributable to the unique cam driven closed circuit hydraulic system which has inherent resiliency since excess fluid in the system may be bypassed to the reservoir 36. In this respect, the branch conduits 37 and 38 will be provided with check valves which are normally closed but which will allow the fluid to return to the reservoir in response to an excess pressure being exerted in the system lines. The valves 33 may also be adjusted to vary the line pressure with respect to the slave cylinder 23.

The master cylinder 42 has a greater volume capacity than the slave cylinder 23 and the bypass arrangement of the manifold permits return of fluid past the check valves in the branch conduits into the reservoir 36 in the event that the table is not allowed to move through its fully retracted or fully extended positions.

The cam groove 54 is also constructed to permit the table 20 to be shifted rapidly during its travel between the extended and retracted positions. However, as the table approaches either the fully extended or the fully retracted positions, the configuration of the cam groove causes deceleration of the table which maximizes smooth efficient operation of the bolster table device. It will be noted that the cam groove includes curved portions 54*a* which change directions rather abruptly, and these curved portions represent the fully retracted or fully extended positions of the table 20. It is also pointed out that the table 20 has a short dwell time at both the fully retracted and the fully extended positions, although the operation of the cam 52 is continuous.

It will also be noted that during the movement of the table 20, the table will be subject to only a small friction load during substantially its entire travel until it is in the fully retracted position. During the major portion of the travel of the table 20, the table will be supported upon the guideways 15, thus minimizing the effort to shift the table through a complete cycle. As pointed out above, when the table is in the fully retracted position, the confronting inclined planar surfaces of the support plate and table 20 produce a monolithic structure for receiving the impact force from the punch press. With this arrangement, the guideways are completely protected against the impact force of the punch press during its working cycle which reduces wear of these guideways. Since the bolster table device may be operated continuously, the speed control mechanism for the electric motor may be set at some predetermined speed so that the bolster table device in effect paces the punch press operator. This in contradistinction to the conventional method wherein the punch press operator in effect determines the operational speed of the punch press. It is therefore thought that the present bolster table device will noticeably increase the operational efficiency of the punch press operators.

It will further be noted that through the use of confronting inclined planes on the table and support plates, we have not only provided a virtual friction-free system for shifting the table between extended and retracted positions, but we have also provided a solid monolithic structure for receiving the impact force from the punch press while precluding damage to the guideways for the table.

It will also be noted that through the use of a cam operated closed hydraulic system for operating the bolster table, we have provided a system which has inherent resiliency as well as one which permits continuous cyclic operation.

Thus it will be seen that we have provided a novel bolster table device for punch presses, which is not only of relatively simple and inexpensive construction and operation, but one which functions in a more efficient manner than any heretofore known comparable device.

What is claimed is:

1. A bolster table device for a punch press apparatus of the type having a power operated press, vertically shiftable through a working cycle into and out of engaging relation with a workpiece on the bolster table device, said bolster table device comprising:

a stationary support plate, spaced apart, substantially parallel elongate guideways, a bolster table engaging said guideway for reciprocating movement between an outer extended position and an inner retracted position disposed below the press to permit a workpiece to be engaged by the latter, means for reciprocating said bolster table through a cycle between said outer extended position, to the inner retracted position, and for return to the outer extended position, said reciprocating means including a closed circuit fluid pressure system, a driven cam mechanism operatively connected with said pressure system for operating the latter and means for driving said driven cam mechanism.

2. The bolster table device as defined in claim 1 wherein said closed fluid pressure system comprises a hydraulic system including a slave cylinder connected with said bolster table for shifting the same, a master cylinder connected in controlling communicating relation with said slave cylinder, and means interconnecting said cam mechanism with said master cylinder for operating the latter.

3. The bolster table device as defined in claim 2 wherein said cam mechanism includes a cam plate having a continuous cam groove therein, and said drive means being operable to revolve said cam plate.

4. The bolster table device as defined in claim 2 wherein said interconnecting means comprises an operating lever connected with said master cylinder and engaging said cam mechanism.

5. The bolster table device as defined in claim 3 wherein said interconnecting means comprises an operating lever connected with said master cylinder and having means thereon engaging said cam groove in said cam plate.

6. The bolster table device as defined in claim 1 wherein said support plate has an inclined planar upper surface inclined downwardly and outwardly, and wherein said table has a complimentary inclined planar lower surface inclined downardly and outwardly, said lower surface of said table being disengaged and spaced from the upper inclined surface of the support plate whereby said table is supported by the guideways during substantially its entire travel through each cycle, the inclined upper surface of said support plate engaging the complimentary matching inclined lower surface of said table when the latter is in the fully retracted position, whereby said support plate supports said table only when the table is in the fully retracted position.

7. The bolster table device for a punch press apparatus of the type having a power operated press vertically shiftable through a working cycle into and out of engaging relation with a workpiece on the bolster table device, said bolster table device comprising:

a stationary support plate having inner, outer and opposed side edges, said plate having an upper surface inclined downwardly and outwardly, a pair of laterally spaced apart substantially straight guideways mounted adjacent side edges of said support plate, a table disposed above said support plate and having inner and outer edges and having opposed side edges, side edge portions of the table engaging said guideways, said table having a substantially flat upper surface adapted to support a workpiece thereon and having a lower surface inclined downwardly and outwardly.

means for reciprocating said table through a working cycle between an outer extended position and an inner retracted position below the press, and for return to said outer extended position, the lower inclined surface of the table being disengaged and spaced from the upper inclined surface of the support plate, whereby said table is supported by said guideways during substantially its entire travel through a complete cycle, the inclined upper surface of said support plate engaging the complimentary matching inclined lower surface of said table when the latter is in the fully retracted position, whereby said support plate supports said table only when the table is in the fully retracted position.

8. The bolster device as defined in claim 7 and stop means for limiting movement of the table in the inner retracted direction.

9. The bolster device as defined in claim 7 wherein said means for reciprocating said table comprises a closed circuit hydraulic system including a slave cylinder connected with said table for shifting the same, a master cylinder connected in controlling communicating relation with said slave cylinder, and a cam mechanism connected with said master cylinder for operating the latter.

10. The bolster device as defined in claim 9 wherein said cam mechanism includes a rotary cam having a continuous cam groove therein, and means engaging said cam groove and connected with said master cylinder for operating the latter when the rotary cam is revolved.

* * * * *